United States Patent [19]

Shin-Chin

[11] Patent Number: 4,732,539

[45] Date of Patent: Mar. 22, 1988

[54] OSCILLATING FAN

[75] Inventor: Shao Shin-Chin, San-Chung, Taiwan

[73] Assignee: Holmes Products Corp., Holliston, Mass.

[21] Appl. No.: 829,235

[22] Filed: Feb. 14, 1986

[51] Int. Cl.[4] ..... F04D 29/60

[52] U.S. Cl. ..... 416/100; 416/246; 403/73; 415/126

[58] Field of Search ..... 416/100, 246; 415/129, 415/126; 403/72, 73, 75; 74/426

[56] References Cited

U.S. PATENT DOCUMENTS

| | | | |
|---|---|---|---|
| 1,226,324 | 5/1917 | Gage | 403/93 |
| 2,100,923 | 11/1937 | Schmidt et al. | 416/246 |
| 2,341,220 | 2/1944 | Jordan | 416/100 |
| 2,574,592 | 11/1951 | Schaffer | 403/92 |
| 2,618,434 | 11/1952 | Farnsworth | 416/100 |
| 2,911,245 | 11/1959 | Kurz | 403/95 |
| 4,121,605 | 10/1978 | Schmerl | 403/95 X |

FOREIGN PATENT DOCUMENTS

| | | | |
|---|---|---|---|
| 925553 | 12/1959 | United Kingdom | 416/100 |

*Primary Examiner*—Robert E. Garrett
*Assistant Examiner*—Joseph M. Pitko
*Attorney, Agent, or Firm*—Irving M. Kriegsman

[57] ABSTRACT

An oscillating electric fan having a neck joint which is mounted for tilting movement back and forth on the top of an upwardly projecting portion of a base and a fan unit mounted on top of the neck joint for oscillating movement on the neck joint about a vertical axis includes a flexible clip element which serves to selectively limit the extend of the tilting movement of the neck joint. The clip element, which is attached to the bottom of the neck joint has a hooked shaped tip which will strike the front wall of the upwardly projecting portion of the base when the neck joint is tilted down about 20 degrees from the horizontal axis and as a result prevents further downward tilting movement. However, by manually flexing the clip element upward away from the front wall the neck joint can be tilted further downward so as to place the fan in a collapsed or folded position.

10 Claims, 10 Drawing Figures

OSCILLATING FAN

BACKGROUND OF THE INVENTION

The present invention relates generally to electric fans and more particularly to oscillating type electric fans.

Oscillating fans are well known in the art and commonly used to circulate air. Examples of oscillating fans may be found in U.S. Pat. No. 2,341,220, U.S. Pat. No. 2,725,184 and U.S. Pat. No. 2,811,304. These fans generally include a rotatable fan unit which is arranged to oscillate about a vertical axis and which is mounted on a stand or pedestal for tilting movement backward and forward about a horizontal axis. The tilting movement in a forward direction is usually limited to about 20 degrees downward beyond the horizontal since any further tilting will probably cause the fan to topple over due to its center of gravity.

Oscillating fans are packed for storage and shipping in either an assembled or dissassembled state. The problem with packing the fan in the assembled state is that even when tilted forward it still takes up a lot of space (volume). The problem with packing the fan in the dissassembled state is that it is often very difficult and time consuming to correctly assemble the unit.

The present invention solves the aformentioned problems by providing a fan which can be tilted back and forth about a first arcuate distance for normal use but which when desired, such as for storage or shipping, can be easily tilted beyond the normal range to a folded or collapsed position. The invention achieves this by providing a fan including a flexible clip which is disposed between the lower part of the fan and the upper part, the upper part being tiltable relative to the lower part. In normal use the clip serves as a stop which limits the downward tilting movement of the fan. By manually flexing the clip upward, however, the fan can be tilted beyond the normal angle to a folded down or collapsed position.

According, it is an object of this invention to provide a new and improved electric fan.

It is another object of this invention to provide a new and improved oscillating fan.

It is a further object of this invention to provide a new and improved oscillating fan which can be tilted backward and forward.

It is still a further object of this invention to provide a new and improved oscillating fan which can be tilted backward and forward and which includes an arrangement for selectively limiting the angle of tilt.

It is still a further object of this invention to provide a oscillating fan which can be selectively tilted to a collapsed position for storage purposes.

SUMMARY OF THE INVENTION

An oscillating fan constructed according to the teachings of the present invention includes a base having an upwardly projecting portion terminating in bifurcated portions, a neck joint, means for mounting said neck joint in said bifurcated portions for tilting movement back and forth about a horizontal axis, means for selectively limiting the tilting movement of said neck joint relative to said bifurcated portions, and a fan unit mounted on said neck joint.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 2:
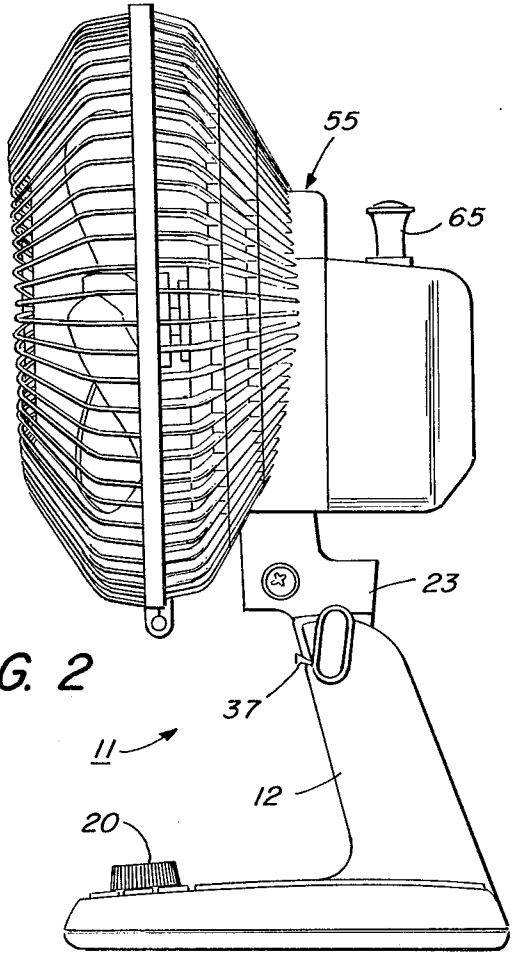
FIG. 2 is a side elevation view of the fan shown in FIG. 1.
Figure 1:
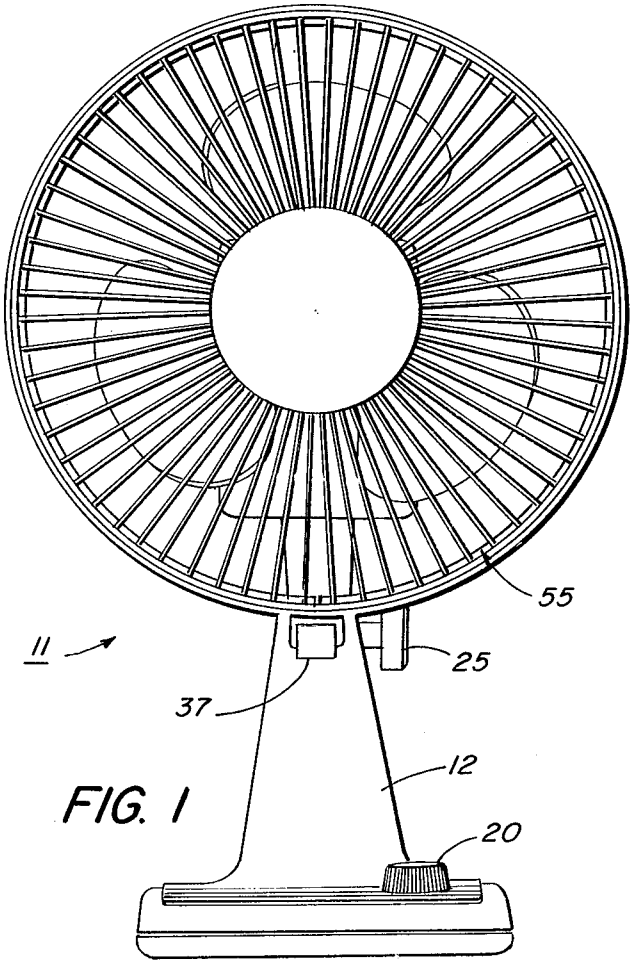
FIG. 1 is a front elevation view of an oscillating fan constructed according to the teachings of the present invention.
Figure 3:
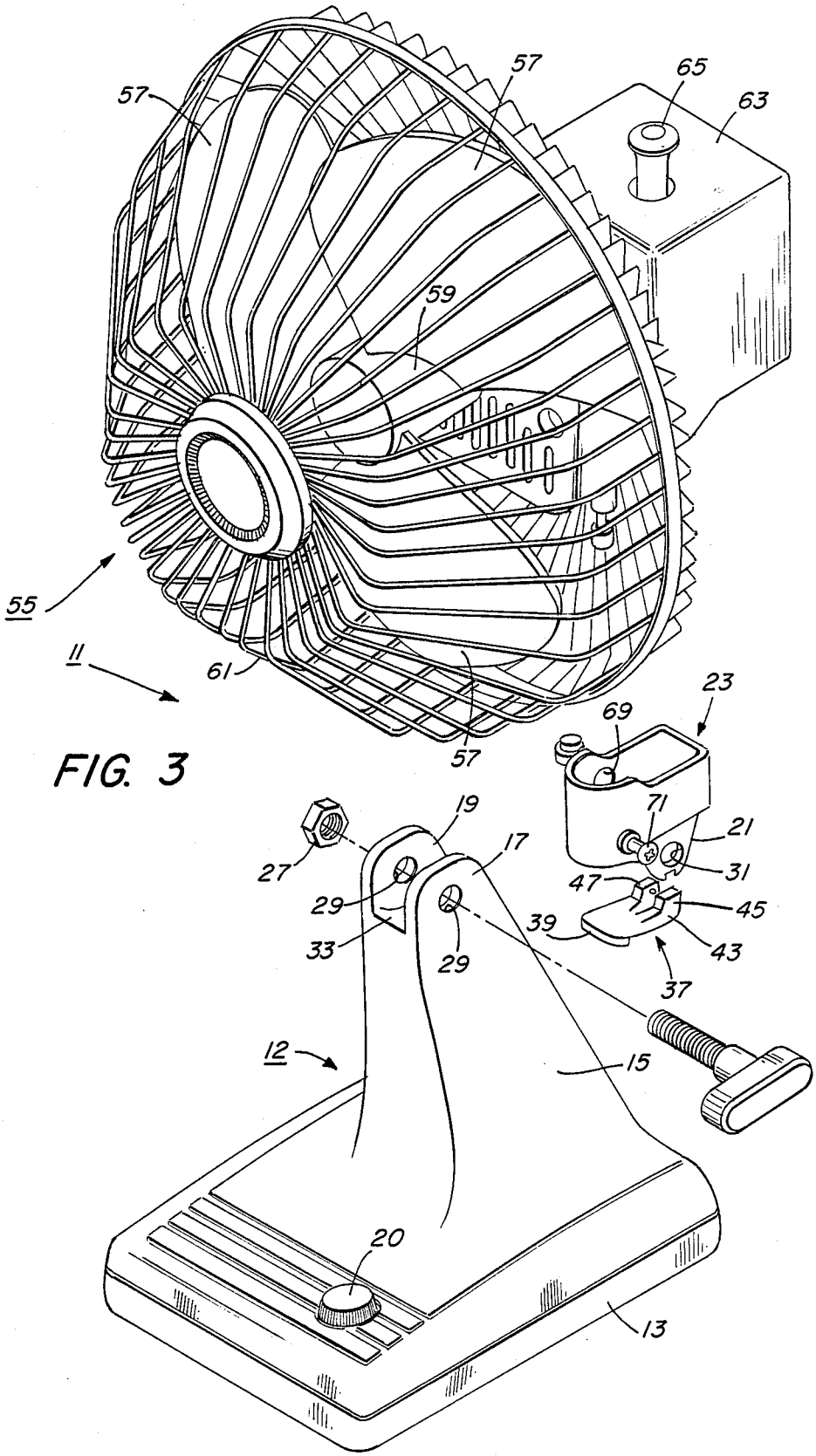
FIG. 3 is a perspective view, partly exploded of the fan shown in FIG. 1.
Figure 10:
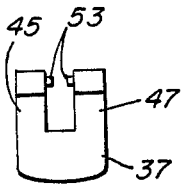
FIG. 10 is a top plan view of the clip shown in FIG. 3.

Referring now to the drawings and first to FIGS. 1 through 3, there is illustrated an oscillating fan constructed according to the teachings of the present invention and identified generally by reference numeral 11. For simplicity, the power cord for connecting fan 11 to a source of electrical power has been eliminated.

Fan 11 includes a stand 12 having a base 13 which includes upwardly projecting portion 15 terminating in bifurcated portions 17 and 19. Upwardly projecting portion 15 is hollow, extends upward from the back of base 13 and is angled slightly forward. A power switch 20 is mounted on base 13 for turning the fan on and off.

A stem 21 of a neck joint 23 is adapted to be received between the bifurcated portions 17 and 19 of upwardly projecting portion 15 and is adjustably secured thereto for tilting movement backward and forward by means of a bolt 25 and nut 27, te bolt extending through holes 29 formed in bifurcated portions 17 and 19 and a hole 31 formed in stem 21 of neck joint 23.

Figure 6:
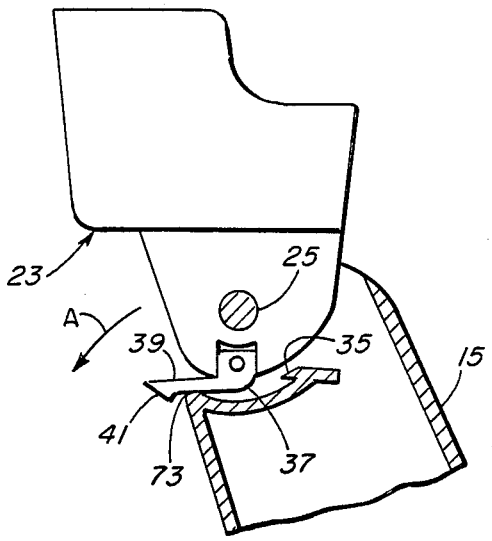
FIGS. 6 through 8 are side views partly in section of the center portion of the fan shown in FIG. 1 illustrating the invention.

Upwardly projecting portion 15 includes a curved center wall or flange 33 (See FIGS. 6 through 8) which extends backard from the front of upwardly projecting portion 15 between the bifurcated portions 17 and 19 and which terminates in a hooked shaped end 35. Holes 29 and 31 are formed in their respective members such that there is a space or clearance between the bottom of stem 21 and center wall 33.

A tilt limiting or regulating clip 37 is attached to the underside of stem 21 of neck joint 23 and is disposed in the space between the bottom of stem 21 and center wall 33. Clip 37 serves to limit the tilting movement of neck joint 23 relative to stand 12 as will hereinafter be described. Clip 37 which is made of flexible plastic and molded includes a front portion 39 which terminates in a hook shaped tip 41 and a back 43 having bifurcated portions 45 and 47. The bifurcated portions 45 and 47 are disposed in slots 49 and 51 formed in the bottom of stem 21 and maintained therein by buttons or projections 53 which snap into a hole 54 formed in the wall between slots 49 and 51.

An oscillating fan unit 55 is rotatable mounted on the top of neck joint 23, the particular electromechanical mechanism for achieving oscillation not being a part of the invention. Fan unit 55 includes a set of fan blades 57 mounted on an axle 59 and enclosed within a safety guard 61. Axle 59 is connected to the drive shaft of a motor (not shown) enclosed within a motor housing 63. The oscillating mechanism is actuated by means of a lever 65. Fan unit 55 is rotatable supported on neck joint 23 by a stud 67 which extends into a cylindrical hole 69 formed in stem 21. A screw 71 serves to limit the vertical movement of stud 67 in neck joint 23.

The manner in which clip 37 limits tilting movement of neck joint 23 (and the fan unit 55 mounted thereon) will now be described.

Figure 7:
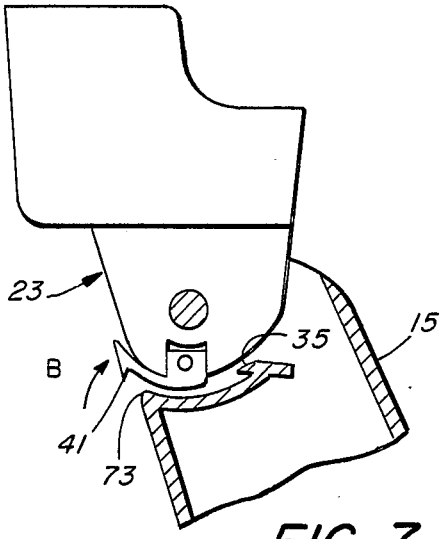
Figure 4:
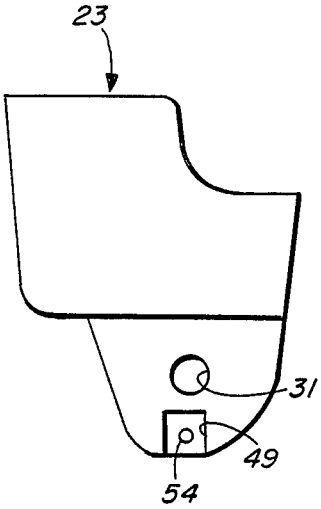
FIGS. 4 and 5 are bottom plan and side elevation views, respectively, of the neck joint shown in FIG. 3.
Figure 5:
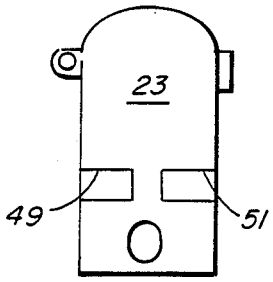
Figure 8:
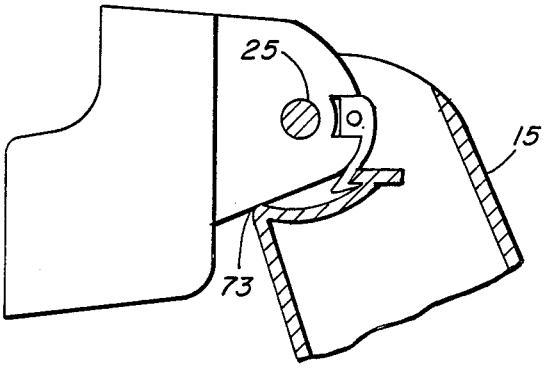
Figure 9:
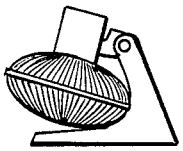
FIG. 9 is a simplified side elevation view showing the fan of FIG. 1 in a collapsed position.

In normal operation (See FIG. 6), after nut 27 has been loosened neck joint 23 can be tilted in a forwardly direction as shown by arrow A until tip 41 of clamp 37 engages the front edge 73 of center wall 33 (and, of course, in a backward direction until the back of neck joint 23 strikes the top back edge of upwardly projecting portion 15). However, as shown in FIG. 7 by flexing tip 41 in an upward direction as shown by arrow B and holding the tip 41 in the flexed position, the tip 41 will not engage edge 73 and prevent further forward tilting movement. Instead, the unit can be further tilted to a folded or collapsed position as shown in FIGS. 8 and 9, with safety guard 61 resting on base 13 and tip 41 engaging hook shaped end 35 of center wall 33. Fan 11 is unfolded by tilting neck joint 23 upwardly a distance at least such that lip 41 extends out beyond edge 73.

As can be appreciated, the invention is not limited solely to oscillating fans.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An electric fan comprising:

a. a base having an upwardly projecting portion terminating in bifurcated portions, b. a neck joint, c. a fan unit mounted on said neck joint, d. means for mounting said neck joint on said bifurcated portions for tilting movement back and forth about a horizontal axis over a defined angular distance.

e. means for maintaining said neck joint in a selected angular position over said defined angular distance, and f. a clip made of flexible material disposed between said neck joint and said bifurcated portions and independent from said maintaining means for limiting the extent of the forward movement of said neck joint relative to said bifurcated portions to a portion of said defined angular distance.

2. The electric fan of claim 1 and wherein said clip is attached to said neck joint.

3. The electric fan of claim 2 and wherein said upwardly projecting portion of the base includes a hooked shaped end and wherein said clip includes front portion having a hooked shaped tip which is adapted to engage said hook shaped end when said neck joint is tilted forward a predetermined portion of said defined angular distance.

4. The electric fan of claim 3 and wherein said neck joint includes a clip mounting hole and wherein said clip includes a pair of projections seated in said clip mounting hole.

5. The electric fan of claim 4 and wherein the means for mounting the neck joint on the bifurcated portions for tilting movement comprises a bolt.

6. The electric fan of claim 5 and wherein the means for maintaining the neck joint in the selected angular position comprises a nut mounted on said bolt.

7. The electric fan of claim 6 and wherein the clip does not limit backward movement of the neck joint.

8. The electric fan of claim 7 and wherein the fan unit includes an oscillating fan.

9. An electric fan comprising:

a. a base, b. a neck joint mounted on said base for tilting movement backward and forward over a defined angular distance, the forward movement being to about a collapsed position, c. a fan unit mounted on said neck joint, d. means for holding said neck joint at a selected angular position over said defined angular distance, and e. a clip made of flexible material disposed between said base and said neck joint for selectively limiting the forward tilting movement of said neck joint relative to said base to less than said collapsed position.

10. The electric fan of claim 9 and wherein said neck joint can be tilted forward to a collapsed position when said clip is unflexed and to about twenty degrees from the horizontal when said clip is flexed upward.

* * * * *